US006374723B1

(12) United States Patent
Cook et al.

(10) Patent No.: US 6,374,723 B1
(45) Date of Patent: Apr. 23, 2002

(54) RETROFIT DRIP RING FOR A HYDRAULIC PISTON ASSEMBLY

(75) Inventors: Michael Cook; Frank Harper, both of Antioch; Douglas Grant, Foster City, all of CA (US)

(73) Assignee: Advancing Technologies, Antioch, CA (US)

( * ) Notice: Subject to any disclaimer, the term of this patent is extended or adjusted under 35 U.S.C. 154(b) by 0 days.

(21) Appl. No.: 09/664,808

(22) Filed: Sep. 19, 2000

(51) Int. Cl.[7] ..... B66B 9/04
(52) U.S. Cl. ..... 92/86
(58) Field of Search ..... 92/86

(56) References Cited

U.S. PATENT DOCUMENTS 4,017,214 A * 4/1977 Smith ..... 92/86
4,463,663 A * 8/1984 Hanson, Jr. et al. ..... 92/86

FOREIGN PATENT DOCUMENTS

JP 11139723 A * 5/1999

* cited by examiner

*Primary Examiner*—Edward K. Look
*Assistant Examiner*—Thomas E. Lazo
(74) *Attorney, Agent, or Firm*—McCutchen, Doyle, Brown & Enerson LLP; David G. Beck

(57) ABSTRACT

A drip ring for use with a hydraulic cylinder is provided. The drip ring is prefabricated from a flexible material. To size the prefabricated drip ring, the drip ring is cut and wrapped around the hydraulic cylinder that is to be fitted. The amount of excess drip ring material is measured and removed. The properly sized drip ring is then placed around the cylinder such that the two cut edges are positioned within a bonding fixture that has been pre-filled with a bonding compound. The inner flange of the drip ring is secured against the hydraulic cylinder with an adjustable, metal restraining strap. If desired, a drain fixture coupled to a drain pipe is attached to the fitted drip ring.

15 Claims, 3 Drawing Sheets

RETROFIT DRIP RING FOR A HYDRAULIC PISTON ASSEMBLY

FIELD OF THE INVENTION

The present invention relates generally to hydraulic systems and, more particularly, to a drip ring that can be retrofitted to a hydraulic elevator system.

BACKGROUND OF THE INVENTION

Hydraulic systems are used in a variety of different applications, including hydraulic elevator lifts such as those commonly used in automobile maintenance garages. After repeated usage, such hydraulic systems typically begin to experience hydraulic fluid leakage in the seal between the piston and the hydraulic cylinder. Depending upon the application, it may be permissible to allow relatively large amounts of fluid to leak from the cylinder prior to performing system maintenance. Unfortunately, if the lost hydraulic fluid is not properly reclaimed and recycled, it may pose both an environmental hazard and a health/safety hazard to workers as well as an economic loss to the system operator.

Hydraulic elevator systems are often retrofitted with a metal drip ring. The drip ring collects hydraulic fluid that leaks through the packing gland, allowing the fluid to either be properly disposed of or recirculated. Unfortunately, the retrofitted metal drip ring will often leak due to the difficulties associated with obtaining a tight fit between the metal drip ring and the hydraulic cylinder. Additionally as the metal drip ring is custom designed and fabricated to fit a specific hydraulic cylinder, the fabrication can be relatively costly, thereby prohibiting its use in many applications. Lastly, as the hydraulic system cannot be used during the installation process, the end user may experience lost revenues due to system down time.

What is needed in the art is an inexpensive drip ring that can be easily sized and retrofitted to a hydraulic cylinder, and which can be easily sealed to the hydraulic cylinder. The present invention provides such an apparatus.

SUMMARY OF THE INVENTION

The present invention provides a drip ring and a method of retrofitting the drip ring to the hydraulic cylinder of a hydraulic elevator or other hydraulic system. The prefabricated drip ring is comprised of a flexible material that, prior to sizing, is in the shape of an oversized drip ring. To size the prefabricated drip ring, the drip ring is cut and wrapped around the hydraulic cylinder that is to be fitted. The amount of excess drip ring material is measured and removed. The properly sized drip ring is then placed around the cylinder such that the two cut edges are positioned within a bonding fixture that has been pre-filled with a bonding compound. The inner flange of the drip ring is secured against the hydraulic cylinder with an adjustable, metal restraining strap. Lastly a drain fixture and drain pipe is attached to the fitted drip ring.

A further understanding of the nature and advantages of the present invention may be realized by reference to the remaining portions of the specification and the drawings.

DESCRIPTION OF THE SPECIFIC EMBODIMENTS

Figure 1:
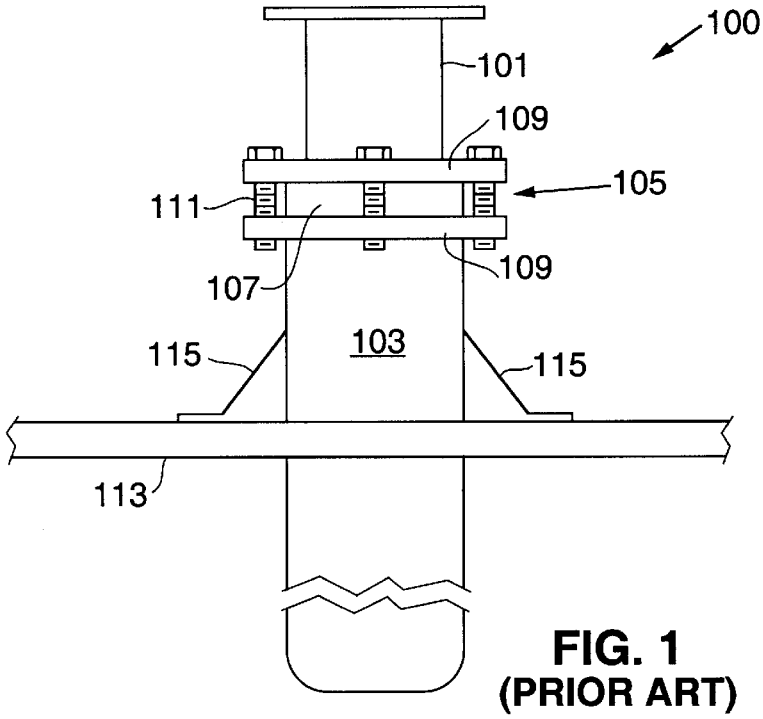
FIG. 1 (PRIOR ART)
FIG. 1 is a schematic illustration of a hydraulic cylinder assembly according to the prior art.

FIG. 1 is a schematic illustration of a hydraulic system 100 according to the prior art. System 100 includes a hydraulic piston 101 fitted within a hydraulic cylinder 103. A packing gland assembly 105 prevents excessive leakage of hydraulic fluid from between piston 101 and cylinder 103. Assembly 105 includes a seal or packing gland 107 and a pair of retaining rings 109. The retaining rings are coupled together, for example with bolts 111, thereby securing packing gland 107. By varying the level of hydraulic fluid within cylinder 103, the hydraulic pressure exerted on piston 101 is controlled, as is the position of piston 101. In the embodiment shown in FIG. 1, cylinder 103 is attached to a surface 113 via a plurality of mounting flanges 115. It is understood that the present invention is not limited to hydraulic systems mounted as shown in FIG. 1 and that FIG. 1 is only meant to illustrate a generic hydraulic system for which the present invention can be utilized.

Figure 2:
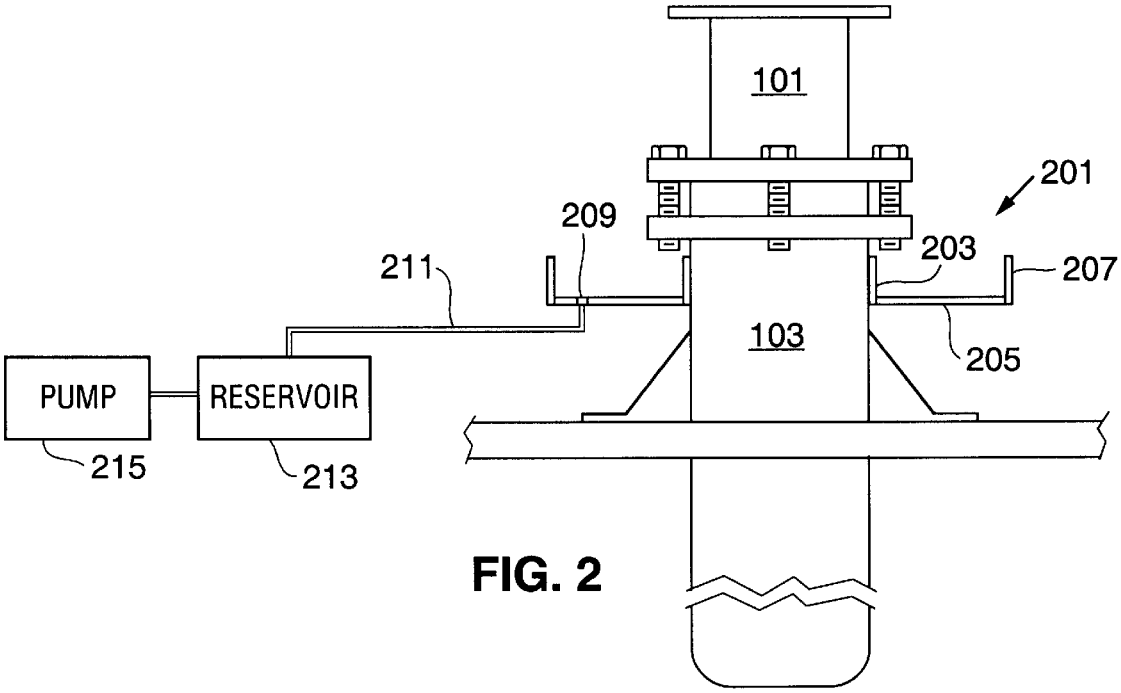
FIG. 2 is a schematic illustration of a drip ring assembly.

FIG. 2 is an illustration of a drip ring assembly 201. As shown, drip ring assembly 201 is comprised of a mounting flange 203, a bottom plate 205, and an outer flange 207. The seam between flange 203 and plate 205 as well as the seam between flange 207 and plate 205 is sealed to prevent hydraulic fluid leakage. Preferably mounting flange 203 is sealed to the body of cylinder 103, thus preventing hydraulic fluid from bypassing drip ring assembly 201.

Drip ring assembly 201 can be used to merely collect hydraulic fluid leaking from between piston 101 and cylinder 103. In this configuration, however, assembly 201 must be periodically emptied to prevent overflow. Accordingly, a preferred configuration of assembly 201 includes a reclamation system. A typical reclamation system includes a drip ring drain 209, a drain line 211, and a hydraulic reservoir 213. Preferably a return pump 215 is coupled to reservoir 213, thus allowing the collected hydraulic fluid to be reused. Typically prior to reuse the collected hydraulic fluid is subjected to a filtering process to remove any contaminants that can reduce the fluid's performance.

Figure 3:
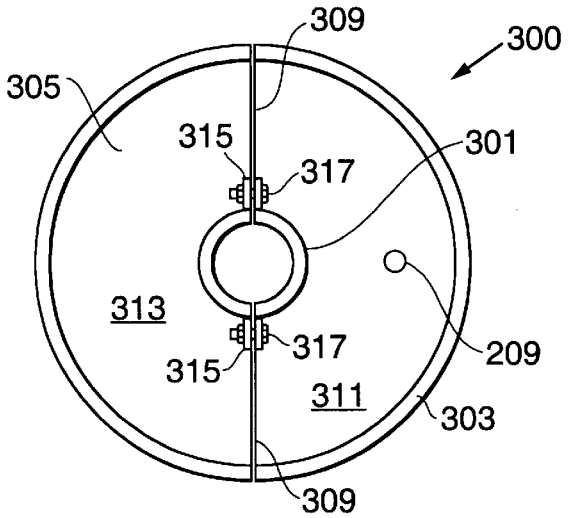
FIG. 3 (PRIOR ART)
FIG. 3 is a schematic illustration of a top view of a drip ring assembly according to the prior art.
Figure 4:
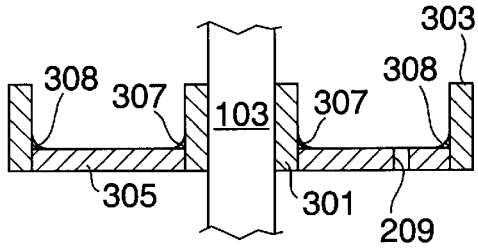
FIG. 4 (PRIOR ART)
FIG. 4 is a cross-sectional view of the drip ring assembly shown in FIG. 3.

FIGS. 3 and 4 provide a top view and a cross-sectional view, respectively, of a drip ring assembly 300 according to the prior art. Drip ring assembly 300 is comprised of multiple metal pieces, specifically an inner flange 301, an outer flange 303, and a bottom plate 305. To form and size inner flange 301, a metal bar is bent around the hydraulic cylinder to be fitted. Plate 305 is then cut to size and welded to flange 301 along a seam 307. Outer flange 303 is then cut, shaped, and welded to plate 305 along a seam 308. Once assembled, drip ring assembly 300 is cut along a line 309 in order to form two separate drip ring sections 311 and 313. Alternately, drip ring sections 311 and 313 can be individually fabricated. Regardless of the fabrication process, once fabricated the two sections of the drip ring assembly are assembled around cylinder 103, preferably utilizing multiple coupling flanges 315 and coupling bolts 317 to clamp the two sections together. Coupling flanges 315 are typically comprised of small angle flanges welded to bottom surface 305 of sections 311 and 313. Lastly, the juncture between the two sections is sealed in order to prevent hydraulic fluid leakage.

Assuming that assembly 300 properly seals to cylinder 103 and that the junction of the two subassemblies, sections 311 and 313, as well as seams 307 and 308, are properly sealed, the prior art drip ring assembly can be used to solve the problem of hydraulic fluid leakage. This assembly does, however, prevent usage of the hydraulic elevator for extended periods of time, both while flange 301 is shaped to fit cylinder 103 and during final fitting of subassemblies 311 and 313. Additionally, each assembly 300 is costly, both in terms of material and fabrication time, as each assembly requires multiple operations such as cutting plate 305 and coupling flanges 315, bending and cutting flanges 301 and 303, welding seams 307, 308, and coupling flanges 315, and cutting the fabricated assembly into subassemblies 311 and 313. Due to the custom fit of each assembly 300, cost savings through large production runs cannot be realized. Lastly, it is often difficult to seal the many seams inherent in the design of assembly 300 (e.g., seams 307–308 and the juncture of the two subassemblies).

Figure 5:
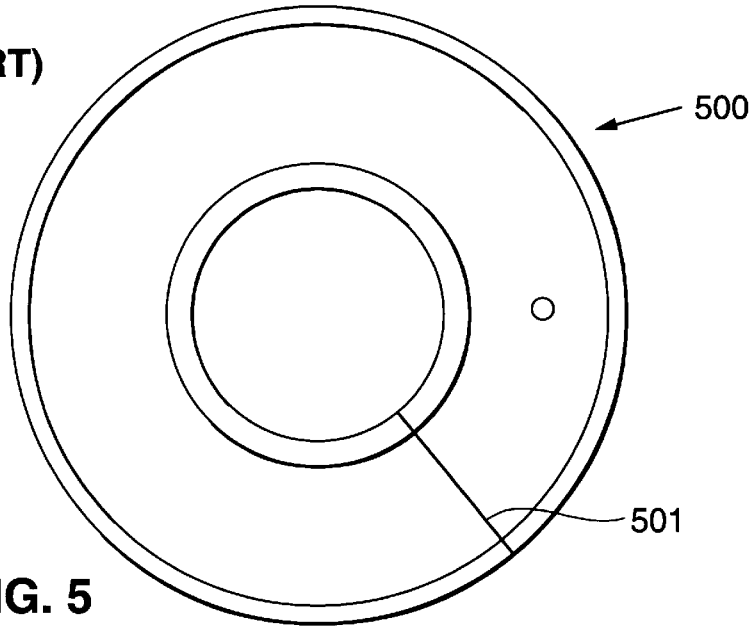
FIG. 5 is a schematic illustration of a top view of a drip ring according to the invention.
Figure 6:
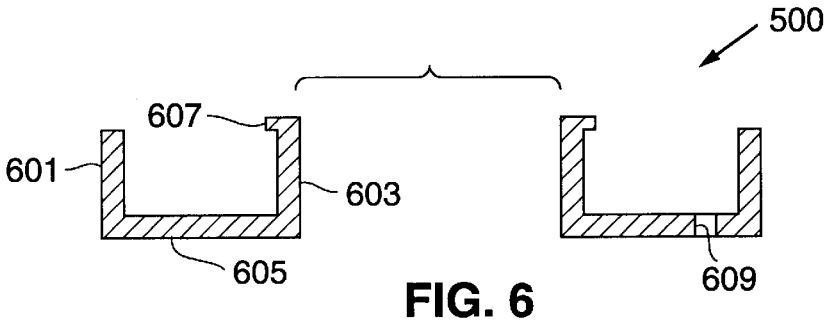
FIG. 6 is a cross-sectional view of the drip ring shown in FIG. 5.

FIGS. 5 and 6 provide a top view and a cross-sectional view, respectively, of a prefabricated drip ring 500 according to the invention. As shown, drip ring 500 is comprised of a single piece of flexible material, such as a thermoplastic (e.g., vinyl) or a thermosetting plastic. The preferred embodiment utilizes polyurethane, 90 durometer. Drip ring 500 includes an outer side wall 601, an inner mounting flange 603, and a bottom portion 605. Preferably drip ring 500 also includes a lip 607. In the preferred embodiment, ring 500 also includes a drain 609, allowing ring 500 to be coupled to a drain line and a reclamation system (not shown).

Figure 7:
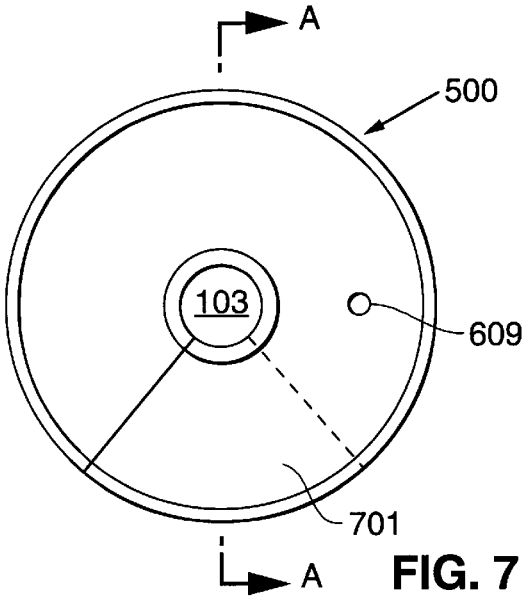
FIG. 7 is a schematic illustration of the drip ring shown in FIGS. 5 and 6 wrapped around a hydraulic cylinder.
Figure 8:
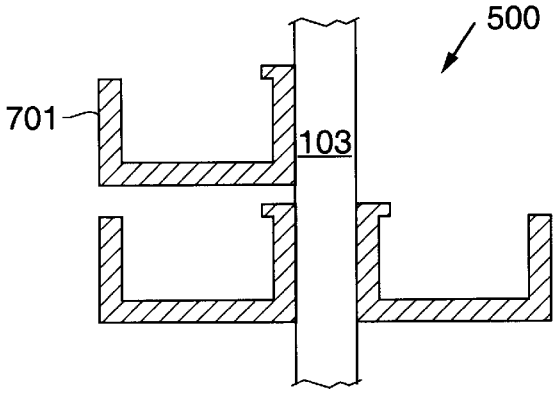
FIG. 8 is a cross-sectional view of the drip ring of FIG. 7 taken along a section A—A.

To fit prefabricated drip ring 500 to a hydraulic cylinder, the ring is cut along a line 501. As drip ring 500 is fabricated from a flexible material such as a thermoplastic, it can be readily cut at the job site using a common cutting instrument (e.g., pocket knife, utility knife, etc.). After cutting, drip ring 500 is wrapped around the hydraulic cylinder, as illustrated in FIG. 7, causing an overlapping of the drip ring by a portion 701. FIG. 8 further illustrates portion 701, FIG. 8 being a cross-sectional view of drip ring 500 taken along a section A—A.

Figure 9:
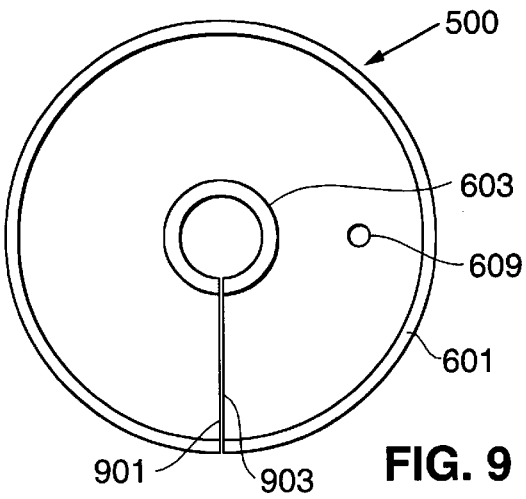
FIG. 9 is a schematic illustration of the drip ring of FIG. 7 with the excess material removed.

The next step is the removal of portion 701, once again using a common cutting instrument such as a pocket knife or utility knife. The resulting drip ring, as illustrated in FIG. 9, includes cut edges 901 and 903. Is should be appreciated that by bringing edges 901 and 903 together, as shown, the resultant drip ring is correctly sized for hydraulic cylinder 103.

Figure 10:
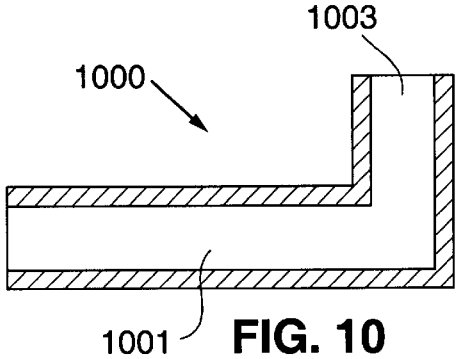
FIG. 10 is a side view of the preferred bonding fixture.
Figure 11:
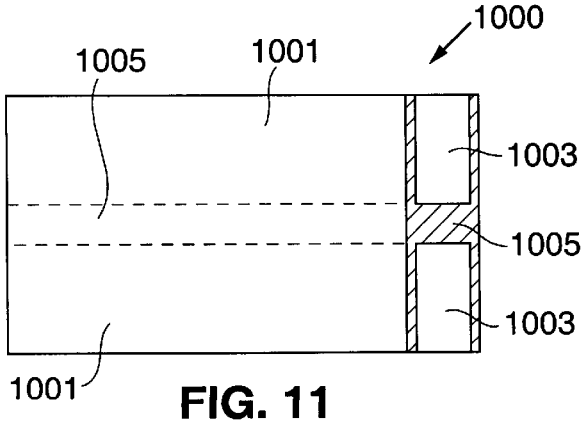
FIG. 11 is a top view of the preferred bonding fixture.
Figure 12:
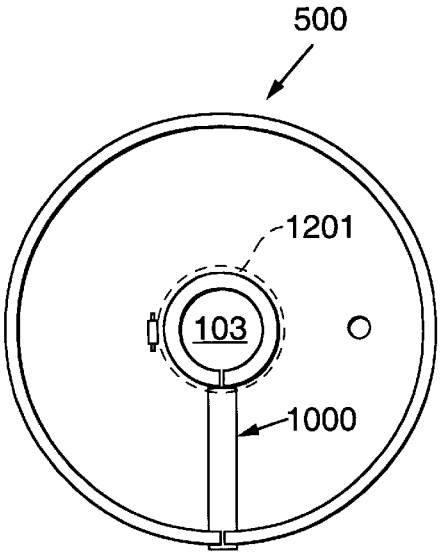
FIG. 12 is a schematic illustration of the drip ring utilizing the preferred bonding fixture.

In order to form the desired drip ring, drip ring 500 is placed around hydraulic cylinder 103 and edges 901 and 903 are coupled together. Preferably a bonding fixture 1000 is used, such as that illustrated in FIGS. 10–12. FIGS. 10 and 11 are cross-sectional and top views, respectively, of bonding fixture 1000 while FIG. 12 illustrates the use of fixture 1000 to couple edges 901 and 903 of drip ring 500.

Bonding fixture 1000 can be fabricated from almost any non-porous material. Preferably fixture 1000 is fabricated from a lightweight material which is easily machined or cast. For example, fixture 1000 can be fabricated from a plastic (e.g., thermoplastic or thermosetting plastic) using a molding process (e.g., injection molding) or a casting process.

On either side of fixture 1000 is a groove comprised of a horizontal portion 1001 and a vertical portion 1003. A wall 1005 separates the groove located on the first side of the fixture from the groove located on the second side of the fixture. During use, the two grooves are filled with a bonding material that is impervious to the hydraulic fluid and which forms a suitable bond between the material comprising drip ring 500 and bonding fixture 1000. In the preferred embodiment a silicone adhesive sealant is used as the bonding material. After the bonding material has been applied to the grooves, edge 901 is fit into the groove on the first side of the fixture such that the bottom surface 605 of edge 901 fits within groove 1001 and outer wall 601 of edge 901 fits within groove 1003. Similarly, edge 903 is fit into the groove on the second side of the fixture such that the bottom surface 605 of edge 903 fits within groove 1001 and outer wall 601 of edge 903 fits within groove 1003.

To complete the fitting of drip ring 500 to hydraulic cylinder 103, a clamping device 1201 is fit around mounting flange 603 such that, once tightened, the inner surface of mounting flange 603 is compressed against the outer surface of hydraulic cylinder 103. Preferably a sealant (e.g., a silicone sealant) is applied to the mating surfaces of flange 603 and cylinder 103 prior to tightening the clamping device, thereby insuring a leak-proof seal. Although a variety of clamping devices can be used, preferably a stainless steel, worm drive clamp is used as such a clamp provides a uniform clamping force. Preferably clamping device 1201 (e.g., worm drive clamp) includes a continuous clamping band that fits between bottom surface 605 and lip 607.

Although drip ring 500 can be used to merely collect hydraulic fluid leakage, preferably drain 609 is installed and attached to a drain line fitted to a reclamation system as previously described.

As will be understood by those familiar with the art, the present invention may be embodied in other specific forms without departing from the spirit or essential characteristics thereof Accordingly, the disclosures and descriptions herein are intended to be illustrative, but not limiting, of the scope of the invention which is set forth in the following claims.

What is claimed is:

1. A method of mounting a flexible drip ring to a hydraulic cylinder, the method comprising the steps of:

cutting the flexible drip ring along a line extending from an inner mounting flange to an outer side wall, wherein said cutting step creates a first drip ring edge and a second drip ring edge;

wrapping the flexible drip ring around the hydraulic cylinder;

removing excess drip ring material;

coupling said first drip ring edge to said second drip ring edge;

locating a clamping device around said inner mounting flange; and applying a compressive force to said inner mounting flange with said clamping device.

2. The method of claim 1, further comprising the step of fabricating the flexible drip ring, wherein said inner mounting flange of said fabricated, flexible drip ring is continuous and wherein said outer side wall of said fabricated, flexible drip ring is continuous, wherein said fabricating step is performed prior to said cutting step.

3. The method of claim 2, wherein the flexible drip ring is fabricated from a plastic.

4. The method of claim 3, wherein said fabricating step is further comprised of the step of molding the flexible drip ring from said plastic.

5. The method of claim 1, wherein said wrapping step includes the step of temporarily compressing said inner mounting flange around the hydraulic cylinder, and wherein said excess drip ring material is comprised of overlapping drip ring material.

6. The method of claim 1, further comprising the steps of positioning at least a portion of said first drip ring edge within a first groove in a coupling fixture and positioning at least a portion of said second drip ring edge within a second groove in said coupling fixture.

7. The method of claim 6, further comprising the step of filling said first groove and said second groove of said coupling fixture with a bonding material, wherein said filling step is performed prior to said positioning steps.

8. The method of claim 1, further comprising the step of applying a sealing material between said inner mounting flange and the hydraulic cylinder, wherein said applying step is performed prior to said step of applying a compressive force to said inner mounting flange.

9. The method of claim 1, further comprising the step of coupling a drain and a drain line to said flexible drip ring.

10. A drip ring retrofitting kit for use with a hydraulic cylinder, the kit comprising:

a flexible drip ring comprised of a continuous inner mounting flange, a continuous outer side wall, and a bottom surface coupling said continuous inner mounting flange to said continuous outer side wall;

a bonding fixture comprised of a first grooved portion and a second grooved portion with a walled portion interposed between said first grooved portion and said second grooved portion, wherein at least a portion of a first drip ring edge formed by cutting said flexible drip ring fits within said first grooved portion of said coupling fixture and wherein at least a portion of a second drip ring edge formed by cutting said flexible drip ring fits within said second grooved portion of said coupling fixture; and an adjustable clamp to apply a compressive force to said inner mounting flange.

11. The drip ring retrofitting kit of claim 10, further comprising a cutting tool for cutting said flexible drip ring along a line extending from said inner mounting flange to said outer side wall to form said first drip ring edge and said second drip ring edge.

12. The drip ring retrofitting kit of claim 10, further comprising a bonding material for use with said coupling fixture.

13. The drip ring retrofitting kit of claim 10, further comprising a drain coupleable to said flexible drip ring.

14. The drip ring retrofitting kit of claim 10, wherein said adjustable clamp is a worm drive clamp.

15. The drip ring retrofitting kit of claim 10, further comprising a sealant for application to said inner mounting flange.

* * * * *